United States Patent [19]

Gerber

[11] 3,936,932

[45] Feb. 10, 1976

[54] METHOD AND APPARATUS FOR MAKING FILTER ELECTRODES

[76] Inventor: Rudolf Gerber, 8134 Adliswil, Birkenweg 11, Switzerland

[22] Filed: Feb. 5, 1975

[21] Appl. No.: 547,400

[30] Foreign Application Priority Data

July 9, 1974 Switzerland ..... 9408/74

[52] U.S. Cl. ..... 29/628; 29/203 D; 72/324; 72/338; 72/367; 113/1 M

[51] Int. Cl.[2] ..... H01R 43/00

[58] Field of Search..... 29/628, 203 D, 203 R, 428, 29/430, 200 B, 202.5; 113/1 R, 1 M, 116 UT; 219/59, 67, 61, 78, 79, 86, 91; 204/206, 207, 208, 209

[56] References Cited

UNITED STATES PATENTS

| | | | |
|---|---|---|---|
| 3,220,107 | 11/1965 | Clark | 219/67 X |
| 3,886,651 | 6/1975 | Vernik et al. | 228/103 |

*Primary Examiner*—Carl E. Hall
*Assistant Examiner*—James R. Duzan
*Attorney, Agent, or Firm*—Karl F. Ross; Herbert Dubno

[57] ABSTRACT

A pair of Ω-section metallic channels are juxtaposed to form a hollow core with their flat flanges coextensively contacting one another. This core is advanced in steps having a length equal to an even multiple of the predetermined distance toward a work station. Strips are pulled off a pair of supplies at this station and the ends of these strips are advanced toward locations on the core which are spaced apart by the predetermined distance. These strips are advanced by an increment on each step advance of the core. The ends of the strips are spot welded to the flanges on the respective side of the core and the end sections are cut between incremental advances of the strips and step advances of the core to leave a pair of strip arms welded to the core and spaced longitudinally apart by the predetermined distance. The free end of each arm is formed with a split and these split ends are bent in opposite directions to opposite sides of the split. The operations of cutting off the end section and splitting the ends can be carried out simultaneously by a single stamping arrangement. The core is held between upper and lower rollers as it is advanced straightly longitudinally toward the station where the arms are applied thereto.

10 Claims, 14 Drawing Figures

1
2
3
4
5
6
8
10
11
12
19
20
20a
21
21a
21b
22
30
31
32
33
A
II
III
S
S/2

4
5
5'
6

4
6
6'
6a
6''

CONTROL MEANS

METHOD AND APPARATUS FOR MAKING FILTER ELECTRODES

FIELD OF THE INVENTION

The present invention relates to a method of and an apparatus for making a filter electrode. More particularly this invention concerns the production of elongated metallic filter electrodes usable in electrostatic precipitators and the like.

BACKGROUND OF THE INVENTION

A dust filter electrode is known which is formed of a pair of Ω-section straight metal channels which are fitted together, concave sides toward each other, with their flat flanges coextensively contacting one another. The hollow core so formed is fitted at regular intervals with laterally extending metallic arms whose ends are frequently split and bent in opposite directions.

It is customary to form such an electrode simply by manually juxtaposing two channel sections of the desired length, then manually spot welding individual preformed arms to the flanges of the core so formed at the desired intervals. It is absolutely essential that the electrodes be perfectly straight and uniform. Such manual manufacture is an extremely expensive and painstaking process. Since it is often necessary to produce electrodes having a length of 12 meters or more, the fabrication process can take up a great deal of space, often requiring a work table and jig that is immense.

OBJECTS OF THE INVENTION

It is therefore an object of the present invention to provide an improved method of and apparatus for making a filter electrode of the above-described general construction.

Another object is the provision of an apparatus which allows such electrodes to be made rapidly yet inexpensively.

SUMMARY OF THE INVENTION

The objects are attained according to the present invention in a system wherein a pair of Ω-section straight metallic channels are juxtaposed with coextensively contacting flanges to form a hollow core. This core is advanced in steps each having a length equal to an even multiple of a predetermined distance toward a work station provided with a pair of supplies of metallic strip and a pair of strip feed means at the station at opposite lateral sides of the core. These strip feed means pull the strips off the supplies and advance the ends of the strips towards locations on the core spaced apart by the above-mentioned predetermined distance in an increment in opposite directions toward opposite lateral sides of the core between the respective strip feed means and the core and serving to spot weld the ends of the strips to the respective coextensively contacting flanges of the core between incremental advances of the strips and step advances of the core. In addition the end sections of each strip are cut off during or after the spot-welding operation but still between incremental advances of the strip and step advances of the core so as to leave a pair of strip arms welded to the core and spaced longitudinally apart by the predetermined distance. The free end of each arm is formed with a split and the split ends of the arms are bent apart in opposite directions to opposite sides of the split.

In accordance with the present invention a pair of stamping means at the station on opposite lateral sides of the core and each between a respective spot-welding means and a respective strip feed means serve to both cut the end section off the respective strip and form the split in the cut-off end section. A pair of bending means are provided at the station on opposite lateral sides of the core and each spaced downstream from a respective spot welding means by a spacing equal to a whole multiple of the predetermined distance for bending of the split ends of the cut-off end sections in opposite directions as described above.

The apparatus according to the present invention is therefore capable of rapidly and automatically producing an electrode of absolutely uniform construction along its length. The only manual work that need be done is loading the core halves into the guide, and keeping a supply of strip material at the work station. Otherwise the entire process is carried out automatically with great precision.

According to another feature of this invention the individual arms are stamped out of the strip material and that end of each arm opposite the split end is formed with a small dimple or bump. The spot-welding is effected directly at this bump so as to insure a very good connection between the arm and the flange, and between the two flanges on the side of the core.

According to yet another feature of this invention the core feed means includes a plurality of sets of rollers which engage under the lateral flanges and either engage over the top of these flanges or at the central part-cylindrical portion of the core so as to guide these cores accurately and prevent any lateral shifting of them.

Although it is possible to feed the core channels continuously to the work station, in practice it has been found more advantageous simply to load individual channel sections into the device. This is due to the fact that, especially when an electrode of 12 meters or greater length is being produced, it is necessary to employ perfectly straight channels. Should the finished product be bowed the filter in which it is installed would arc out and be inoperative. It is also necessary to fit special hangers to the ends of these electrodes.

BRIEF DESCRIPTION OF THE DRAWING

The above and other objects, features and advantages will become more readily apparent from the following, reference being made to the accompanying drawing, in which.

SPECIFIC DESCRIPTION

Figure 1:
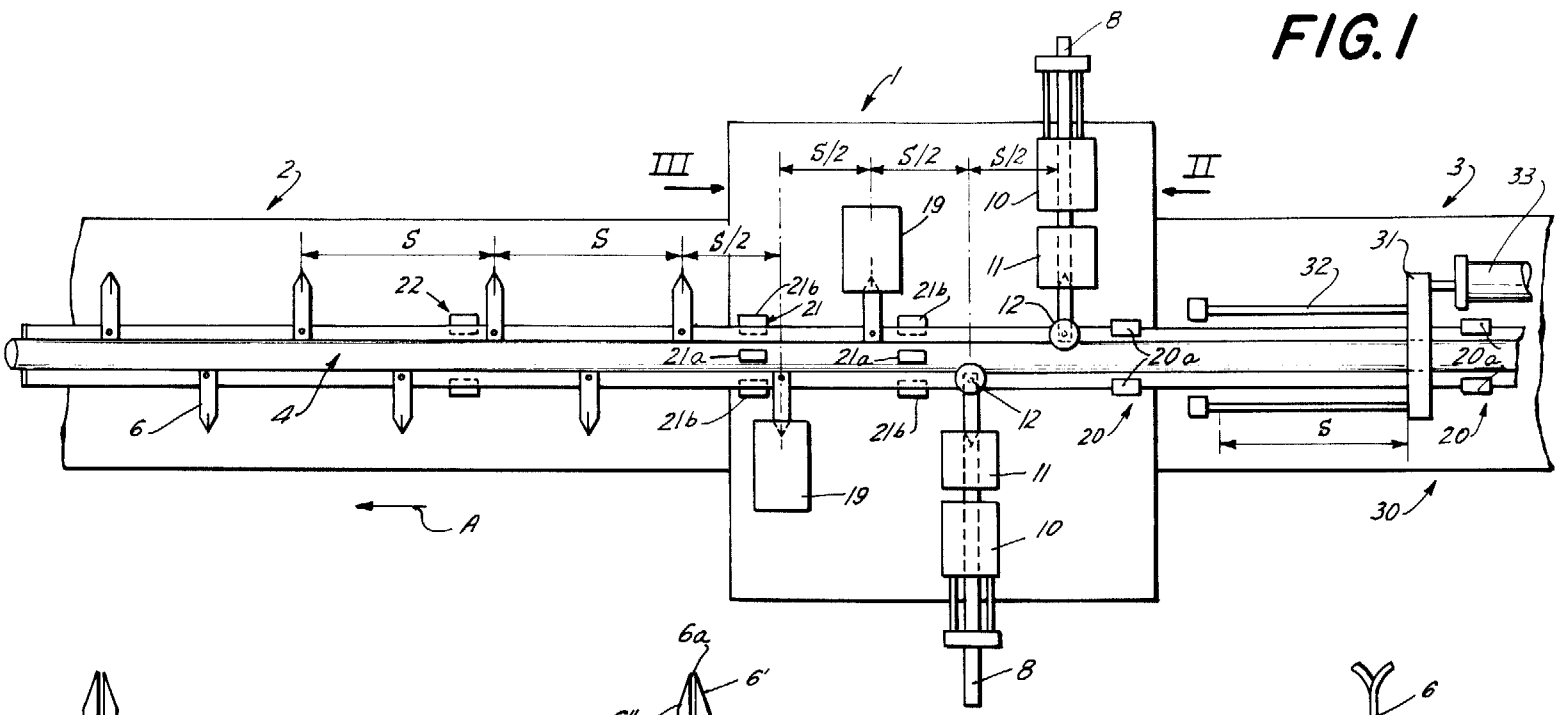
FIG. 1 is a top view of the apparatus according to the present invention with parts removed for clarity of view.
Figure 5:
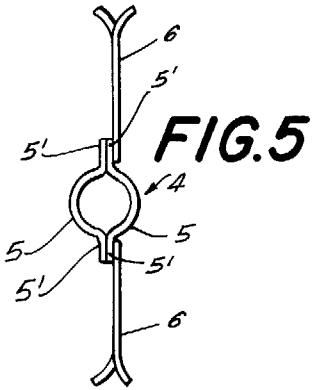
FIGS. 4 and 5 are top and end views of a finished electrode according to the present invention.
Figure 4:
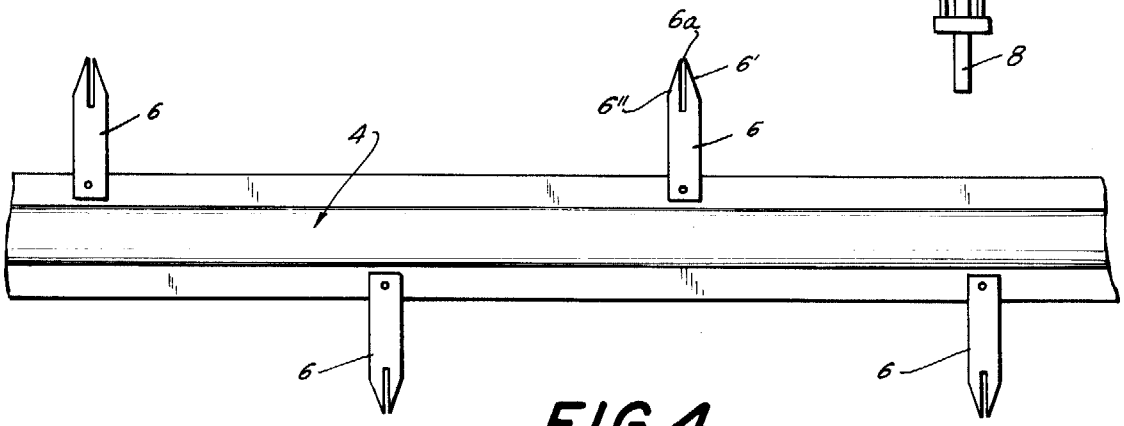

The apparatus according to the present invention as shown in FIG. 1 basically comprises a central working station 1 provided with a downstream output frame 2 and an upstream input or feed frame 3. A feed device 30 is provided at the feed side 3. Two strip feeders 10, stampers 11, spot welders 12, and benders 19 are provided at the work station 1.

Figures 2, 3, 6, 7, 7A, 8A, 8B, 8C, 8D, 8E, 8F:
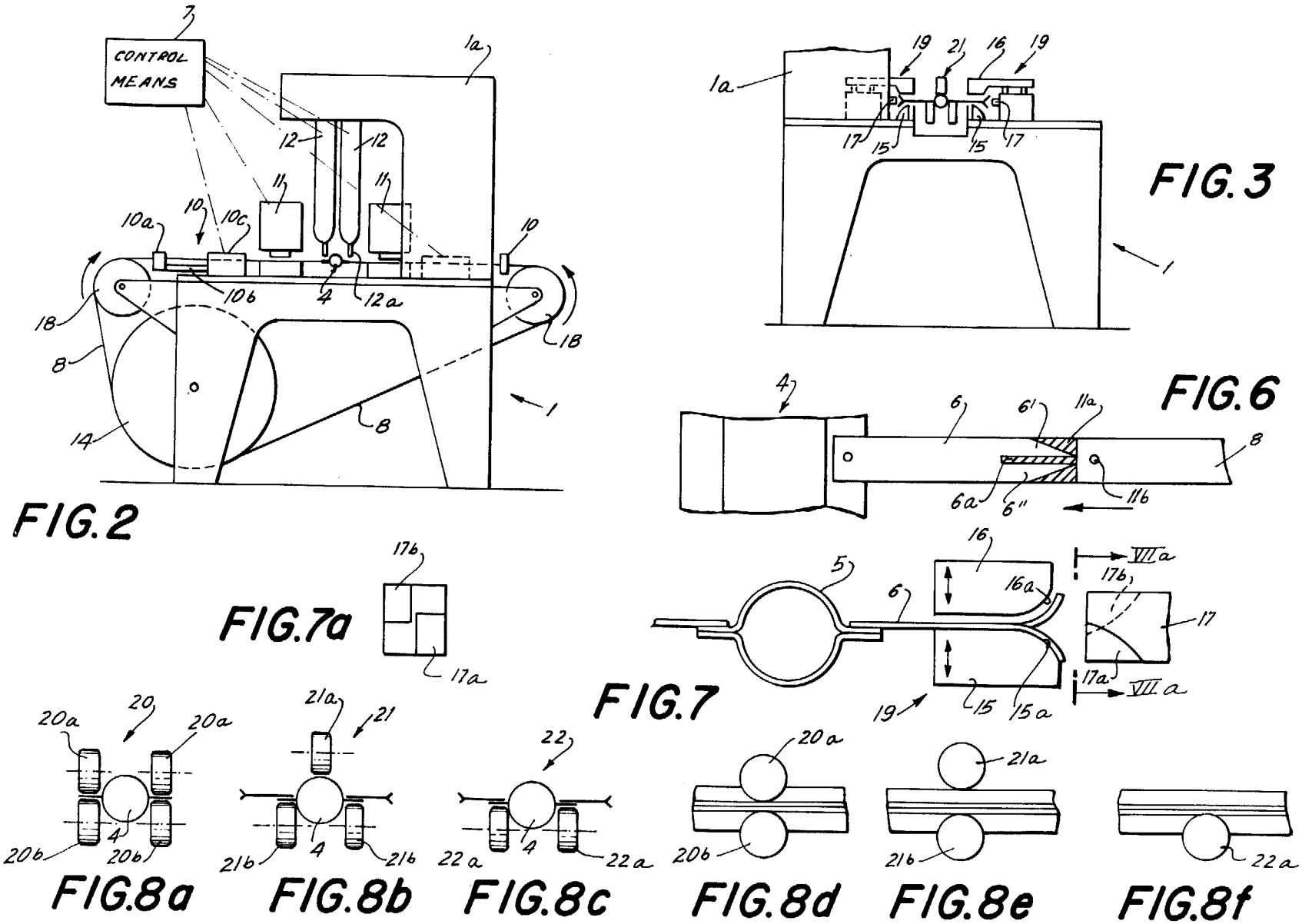
FIG. 2 is an end view taken in the direction of arrow II of FIG. 1.
FIG. 3 is an end view of the apparatus taken in the direction of arrow III of FIG. 2 with parts removed for clarity of view.
FIG. 6 is a top view of a detail of a partly assembled electrode.
FIG. 7 is an end view of a detail of the apparatus of FIG. 1.
FIG. 7A is a section taken in the direction of line VIIA—VIIA of FIG. 7.
FIGS. 8*a*, 8*b*, and 8*c* are end view of the guides for the core according to the present invention.
FIGS. 8*d*, 8*e*, and 8*f* are side views of FIGS. 8*a*, 8*b* and 8*c*, respectively.

At the input station 3 a core 4 formed of a pair of ω-section steel channels 5 having parallel and diametrically opposite flanges 5′ are held in guide roller sets 20. Each set 20 as shown in FIGS. 8*a* and 8*d* is comprised of two upper rollers 20*a* engaging the upper sides of the flanges 5′ and two lower rollers 20*b* engaging the lower sides of the flanges 5′. The feed device 30 comprises a hydraulically operated clamp 31 displaceable along a pair of guide rails 32 through a distance s by means of a hydraulic ram 31. Thus when the clamp 31 is closed and the ram 33 is operated the entire core 4 is advanced in the direction of arrow A through a step having a length equal to s. This cylinder 33 is connected to control means 7 (FIG. 2) which synchronizes all of the actions of the machine and periodically operates the cylinder 33.

The strip feeders 10 at the work station 1 are on opposite sides of the core 4 and spaced apart by a distance s/2. Each such feeder 10 is adapted to pull a strip 8 off a respective roll 14 of strip material carried under the work table 13 of the work station 1. The strip material 8 passes up over a deflecting roller 18 and thence through a clamp 10*a* of the feeder 10. This clamp 10*a* is carried on rods 10*b* in turn connected to a hydraulic actuator 10*c* of the feed 10. Each time the cylinder 33 is actuated by the control means 7 the actuator 10*c* is similarly operated so as to advance the strip 8 by a given increment toward the core 4.

Inward of each feeder 10 is a spot welder 12 which is vertically displaceable on an upright post 1*a* of the apparatus so as to be engageable down against the very innermost end of the respective strip 8 and the flanges 5′ of the underlying core 4. Each of these welders 12 is of the electric type and is only operated by the control means 7 after actuation of the feeds 10 and 30.

Between each of the feeds 10 and the respective welder 12 there is further provided a stamper 11 whose function, as illustrated in FIG. 6, is to cut an end section 6 of the respective strip 8 by removing therefrom a portion as indicated at hatched region 11*a* in FIG. 6. This forms a split 6*a* in the end of the section 6, subdividing it into two pointed tips 6′ and 6″. Simultaneously the mating punch and die of each stamper 11 form a small dimple or boss 11*b* in the very end of the remaining strip 8. The stamper 11 is closed on the strip 8 after incremental advance of this strip 8 and before or during spot welding of the strip 8 to the flanges 5′. The welder 12 is set up to align with the dimple 11*b* and weld the arm 6 so formed to the flanges 5′ at this point, thereby simultaneously welding the two flanges 5′ together.

On the work table 13 the assembly is held and guided by roller sets 21 as shown in FIGS. 8*b* and 8*e* comprising a single upper roller 21*a* engaging the central core section 4 at the top of its semicylindrical portion, and a pair of lower rollers 21*b* engaged under the flanges 5′.

The set of working tools 10, 11 and 12 to each side of the core 4 are spaced longitudinally apart along the core 4 by a distance s/2 so that the arms 6 that are applied to the core are similarly spaced apart a distance s but staggered on opposite sides of the core 4. Downstream by the distance s from each welder 12 is a respective bender 19 shown in more detail in FIGS. 3 and 7. Each such bender 19 comprises a vertically displaceable lower die 15, a vertically displaceable upper die 16 directly above the lower die 15, and a horizontally displaceable punch 17. The two dies 15 and 16 have cylindrically curved side or end surfaces 15*a* and 16*a*. The punch 17 is formed with longitudinally spaced and adjoining cutouts 17*a* and 17*b*, the latter downstream of the former and the two opening in vertically opposite directions. The inner faces of the cutouts 17*a* and 17*b* correspond to the surfaces 15*a* and 16*a*, respectively, so that when the two dies 15 are closed on the end of a flat arm 6 the punch 17 can be brought in between them so as to deflect the tips 6′ and 6″ in opposite directions, and bend them permanently to a Y shape.

At the output side 2 the finished electrode merely rides as shown in FIGS. 8*c* and 8*b* on sets of rollers 22 each comprising a single pair of lower rollers 22*a* engaging the underside of the flanges 5′. The guides 20, 21 and 22 serve to maintain the core in perfectly straight condition and prevent both vertical and lateral displacement of it as the arms 6 are welded thereto and the flanges 5′ are welded together.

The apparatus is made to function by the controller 7 as follows:

A pair of Ω-section steel channels are placed upstream of the feeder 30 on guides similar to the guides 22 and the downstream end of the core 4 so formed is fitted into the clamp 31.

The controller 7 then actuates the cylinder 33 twice until the downstream end of the core 4 is passt the furthest downstream spot welder 12. The feeders 10 are then actuated so as to bring the very ends of the strips 8 into position below the respective spot welder 12 and above the respective flange 5′ of the core 4.

Thereupon the stampers 11 and welders 12 are both actuated so as simultaneously to cut off end sections 6 and weld same to the respective flanges 5′. After this operation is completed the cylinder 33 is again actuated so as to advance the two arms 6 into the benders 19 and bring a fresh section of the core 4 under the spot welders 12.

The dies 15 and 16 of the benders 19 are closed on the respective arms 6 and the punch 17 brought across the bend the tabs 6′ and 6″ in opposite directions. Meanwhile the two feeders 10 have been actuated so as to bring the next arm section 6 up into place and the stampers 11 and welders 12 are again operated so as to secure these new arms 6 to the core 4.

Thereafter the operation goes completely synchronously. That is the feeders 30 and 10 are actuated simultaneously and thereafter the stampers 11, welders 12 and benders 19 are actuated simultaneously. In this manner an accurately manufactured and perfectly uniform electrode is produced.

I claim:

1. An apparatus for making a filter electrode, said apparatus comprising:

core feed means for longitudinally advancing in a transport direction toward a work station and in a succession of steps each having a length equal to an even multiple of a predetermined distance a pair of Ω-section metallic channels having coextensively contacting flat flanges and forming a straight hollow core;

a pair of supplies of metallic strip at said station;

a pair of strip feed means at said station on opposite lateral sides of said core and spaced apart in said transport direction by said distance for advancing said strips by an increment from said supplies incrementally in opposite directions toward said core on each stepwise advance of said core;

a pair of spot-welding means at said station on opposite lateral sides of said core and each between the respective strip feed means and said core for spot welding the ends of said strips to the respective coextensively contacting flanges of said core after each incremental advance of said strips and between step advances of said core;

a pair of stamping means at said station on opposite lateral sides of said core and each between a respective spot-welding means and a respective strip feed means for cutting an end section off the respective strip on each incremental strip advance and for forming in the end of the cut-off end section turned away from said core a split extending transverse to said core; and a pair of bending means at said station on opposite lateral sides of said core and each spaced downstream from the respective spot-welding means by a spacing equal to a whole multiple of said distance for bending the split ends of each cut-off end section in opposite direction on opposite sides of the respective split.

2. The apparatus defined in claim 1 wherein said length of said steps is equal to twice said distance between said stamping means.

3. The apparatus defined in claim 2 wherein said bending means are spaced downstream of said spot-welding means by a spacing equal to said distance.

4. The apparatus defined in claim 1 wherein said stamping means each have a die for forming in the respective strip a boss positioned to lie at said flange after advance of said strip, said spot-welding means being aligned to spot weld each strip at its boss to said flanges.

5. The apparatus defined in claim 1, further comprising guide means including a plurality of sets of rollers longitudinally provided along said core and supporting same, each set including at least two lower rollers engaging said flanges, at least some of said sets engaging down against said core.

6. A method of making a filter electrode comprising the steps of:

juxtaposing a pair of Ω-section straight metallic channels with coextensively contacting flanges to form a hollow core;

advancing said hollow core in steps each having a length equal to an even multiple of a predetermined distance toward a work station;

pulling strips off a pair of supplies of metallic strip material and advancing the ends of said strips toward locations on said core at said station spaced apart by said distance in an increment in opposite directions toward opposite sides of said core on each step advance of said core;

spot welding the end of each strip to the respective flanges of said core and cutting the end section off each strip between incremental advances of said strip and step advances to leave a pair of strip arms welded to said core and spaced longitudinally apart by said distance;

forming the free end of each arm with a split; and bending the split ends of each arm in opposite directions to opposite sides of said split.

7. The method defined in claim 6 wherein said end sections are simultaneously cut from said strips and spot welded to said core.

8. The method defined in claim 7 wherein said splits are formed simultaneously as said end sections are cut from said strips.

9. The method defined in claim 8 wherein said split ends are bent simultaneously as other end sections are cut from said strips.

10. The method defined in claim 9 wherein said core is advanced horizontally and said split ends are bent vertically.

* * * * *